United States Patent [19]

Robinson

[11] Patent Number: 4,567,807

[45] Date of Patent: Feb. 4, 1986

[54] MUTING AND MUFFLING OF DRUMS

[76] Inventor: David F. Robinson, 1274 Star Dr., Atlanta, Ga. 30319

[21] Appl. No.: 445,562

[22] Filed: Nov. 29, 1982

[51] Int. Cl.[4] ..... G10G 7/00; G10D 13/00

[52] U.S. Cl. ..... 84/411 M

[58] Field of Search ..... 84/411–420

[56] References Cited

U.S. PATENT DOCUMENTS 4,325,281 4/1982 Hardy ..... 84/411 M

*Primary Examiner*—Lawrence R. Franklin

*Attorney, Agent, or Firm*—James B. Middleton

[57] ABSTRACT

A mute for drums to reduce unwanted acoustical overtones and ringing. The mute includes a strip of leather, preferably suede, placed adjacent to the drum rim and lying loosely on the drumhead. Attaching flanges extend from the mute and are releasably attached to the drum rim, preferably by hook and teazle material. One such mute, or a plurality, may be used on a single drumhead as desired.

5 Claims, 3 Drawing Figures

MUTING AND MUFFLING OF DRUMS

INFORMATION DISCLOSURE STATEMENT

It is recognized by those skilled in the art that percussion instruments such as drums, tend to exhibit an undesirable ringing sound after the drumhead has been hit. It is desirable to reduce or eliminte this ringing sound, but not to do away with the sustained musical tone of the drum.

The most commonly used for muting or muffling a drum has been for the drummer to lay something on the drumhead. While such an expedient somewhat solves the problem, the solution is non consistent, and may frequently be unattractive in a concert setting. Also, since the drumhead necessarily vibrates during a performance, something simply lying on the drumhead will move around the drumhead, and may interfere with the play of drum.

Another effort at muting or muffling a drum has been through the use of piece of foam material, generally annular in form and being sized to be contiguous with the drum rim. One flat side of the foam is then adhesively fixed to the drumhead. Such an arrangement has been used externally of the drumhead, and U.S. Pat. No. 4,325,281 discloses and claims such an arrangement wherein the foam is attached to the inside of the drumhead. In either event, the full circle of muting or muffling is frequently undesirable, and the adhering of the foam to the drumhead is undesirable. In addition to the fact that the fully circular mute or muffle will reduce the desirable musical tones of the drum, it will be readily understood that the use of an adhesive to fix the foam to the drumhead requires that the mute be disposed of when the drumhead must be disposed of.

One further effort at resolving the problem of the undesirable ringing in a drum is the use of a mechanical arm disposed within the drum, the mechanical arm having a pad of felt or the like to be forcefully urged against the inside of the drumhead. Such an arrangement exerts such force on the drumhead that the total musical quality of the drum is altered. Both because of the alteration of the sound, and because of the complexity of the device, these arrangements have met with little commercial success.

SUMMARY OF THE INVENTION

This invention relates to the muting or muffling of drums, and is more particularly concerned with a simple, easily removable mute for drumheads and the like.

The present invention provides a mute, or muffle, for drumheads and the like comprising a piece of flexible sheet material disposed substantially contiguously with the drum rim and extending somewhat onto the drumhead. Releasable fastening means are provided for attaching the mute to the rim of the drum for holding the mute in the desired position. Hook and teazle material is the preferred attachment means.

In the preferred embodiment of the invention, the sheet material is a soft suede leather, and two or more pieces of the leather may be juxtaposed for the desired weight against the drumhead.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
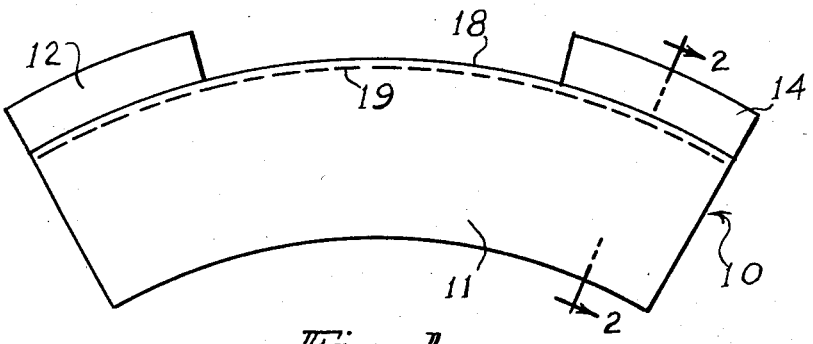
FIG. 1 is a top plan view showing one form of mute made in accordance with the present invention.

Referring now more particularly to the drawings, and to that embodiment of the invention here presented by way of illustration, FIG. 1 shows a mute or muffler made in accordance with the present invention.

It should first be understood that the object of the present invention is to reduce or eliminate the undesirable ringing, or acoustical overtones, in a drum or the like. While a mute for many musical instruments designates a device that causes a softer tone in the desired music, the word mute as used herein relates only to the muting, or softening, of this undesirable ringing of a drum, and is not intended to refer to the desired musical sound.

Figure 2:
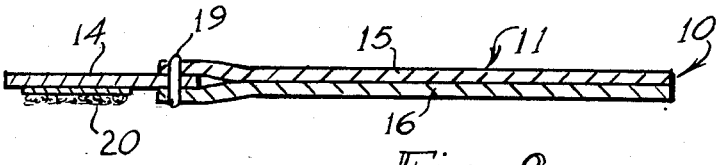
FIG. 2 is an enlarged, cross-sectional view taken substantially along the line 2—2 in FIG. 1; and, FIG. 3 is a perspective view illustrating the mute shown in FIG. 1 exploded from a drum rim to illustrate the manner of attachment.

Looking at FIGS. 1 and 2 of the drawings, it will be seen that the mute generally designated at 10 comprises a mute body 11 having a pair of attaching flanges 12 and 14.

With especial attention to FIG. 2 of the drawings, it will be seen that the mute 10 as here shown includes two thicknesses of material to make up the body 11, the body 11 therefore comprising an upper sheet 15 and a lower sheet 16. At the outer edge 18 of the mute 10, the two sheets 15 and 16 are stitched together as indicated by the stitch line 19.

Those skilled in the art will realize that the attaching flanges 12 and 14 may be produced in numerous ways. The construction here shown utilizes a separate piece of material for the flanges 12 and 14, the flange tab 14 being inserted between the two sheets 15 and 16. The stitches 19 then pass through the sheets 15 and 16, and through the flange 14, to secure the flange 14 in place.

Also shown in FIG. 2 is the attachment means indicated at 20. The attachment means for fixing the flanges 12 and 14 to the drum rim is preferably a hook and teazle material such as "Velcro". Though the hook material and teazle material are interchangeable between the drum rim and the attaching flanges 12 and 14, the teazle material is indicated at 20 as being carried by the flanges 12 and 14. It is likely that the drummer will wish to carry one or more of the mutes 10 on his person, and the teazle material 20 will be more pleasant to encounter than the hook material.

Figure 3:
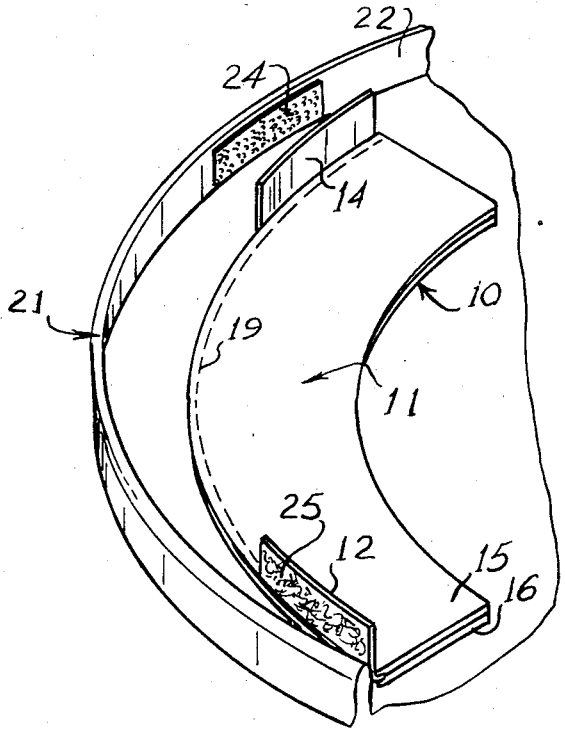

Attention is now directed to FIG. 3 of the drawings which shows the mute 10 in position for attachment to a drum fragmentarily indicated at 21. It will be seen that the rim 22 of the drum 21 has hook material 24 attached thereto. As shown, the mute 10 is arranged adjacent to the rim 22, and the attaching flange 14 is in position to engage the hook material 24. Of course, there would be comparable hook material on the rim to receive the teazle material 25 on the flange 12. Thus, a mute 10 will be fixed to the drum rim 22 in two places, by the attaching flanges 12 and 14. The body 11 of the mute 10 follows the configuration of the rim 22 and extends onto the drumhead, but with no attachment to the drumhead.

Because of the arrangement whereby the mute 10 is held on the drum rim, but is free to move on the drumhead, the mute 10 allows the full resonance between the drum and the drumhead while effectively muting or muffling the undesirable ringing, or acoustical overtones. Further, the drumhead vibrates when it is struck, and will sometimes exhibit a large amplitude vibration. For these large amplitudes, it will be noted that the mute 10 can be urged upwardly by the drumhead, and the mute will fall back into place by gravity.

While the invention has been discussed for use on a drum, it will be recognized by those skilled in the art that the same device can be used on any percussion instrument having a resonant head. Thus, the device of the present invention is equally applicable to all forms of conventional drums, and is also applicable to such instruments as a banjo, or a cymbal.

It will therefore be obvious to those skilled in the art that the particular embodiment of the invention here presented is by way of illustration only, and is meant to be in no way restrictive; therefore, numerous changes and modification may be made, and the full use of equivalents resorted to, without departing from the spirit or the scope of the invention as defined in the appended claims.

What is claimed is:

1. A muting device for a drum, for reducing undesirable ringing of the drum, said drum having a drumhead and a rim surrounding said head, said muting device comprising a body and a pair of attaching flanges carried by said body and extending outwardly therefrom, said body including at least one thickness of soft flexible leather disposed on said drumhead adjacent to said rim, said at least one thickness having sufficient weight to effect the muting, said attaching flanges including releasable attaching means for attaching said flanges to said rim, the arrangement being such that the weight of said body against said head effects the muting of the drum, and said attaching flanges retain the location of said body on said drumhead.

2. A muting device as claimed in claim 1, said at least one thickness constituting said body comprising a plurality of thicknesses of soft flexible leather juxtaposed on one another, and means for fixing said plurality of thicknesses together.

3. A muting device as claimed in claim 2, said body having an outer edge adjacent to said rim, said outer edge having a configuration substantially like the configuration of said rim.

4. A muting device as claimed in claim 5, said attaching means comprising hook and teazle material for rendering said muting device easily removable.

5. A muting device as claimed in claim 1, wherein said leather is suede.

* * * * *